US006012290A

United States Patent [19]

Garcia

[11] Patent Number: 6,012,290

[45] Date of Patent: Jan. 11, 2000

[54] CONDENSER PERFORMANCE OPTIMIZER IN STEAM POWER PLANTS

[76] Inventor: Jaime G. Garcia, 804 Cimarron Dr., Mission, Tex. 78572

[21] Appl. No.: 09/100,795

[22] Filed: Jun. 19, 1998

[51] Int. Cl.[7] ..... F01K 13/00

[52] U.S. Cl. ..... 60/676; 60/652; 60/688

[58] Field of Search ..... 60/692, 670, 676, 60/688, 690, 663

[56] References Cited

U.S. PATENT DOCUMENTS

| | | | |
|---|---|---|---|
| 2,902,831 | 9/1959 | Ipsen et al. | 60/663 |
| 3,881,548 | 5/1975 | Budenholzer . | |
| 4,291,537 | 9/1981 | Oplatka . | |
| 4,353,217 | 10/1982 | Nishoka et al. | 60/690 |
| 4,506,508 | 3/1985 | Coers et al. | 60/688 |
| 4,631,925 | 12/1986 | Ohtake et al. | 60/688 |
| 5,647,199 | 7/1997 | Smith | 60/39.182 |

*Primary Examiner*—Noah Kamen

[57] ABSTRACT

A large electrical power plant includes two operating units, one of which is more efficient and is run as a base load unit. The less efficient operating unit is run only during periods of peak demand or when the more efficient unit is down. Hot condensate from the more efficient unit is cooled in the condenser of the less efficient unit and then sprayed into the turbine outlet of the more efficient unit. This condenses steam more efficiently, at a lower pressure, and allows the more efficient unit to produce more electricity because there is a greater pressure differential across the turbine. In addition, cool condensate is sprayed into the duct connecting the turbine and the condenser to reduce choking flow, when it is prone to occur. In addition, cool make up water is sprayed into the condenser of the operating unit.

11 Claims, 1 Drawing Sheet

BOILER
CONDENSER
COOLING TOWER
CONDENSER
COOLING TOWER

CONDENSER PERFORMANCE OPTIMIZER IN STEAM POWER PLANTS

This invention relates to large electrical generating plants, and more particularly, to a method and apparatus for optimizing the performance of condensers used to condense exhaust steam from steam turbines and thereby optimize performance of the turbines.

BACKGROUND OF THE INVENTION

Large power plants, by which is meant electrical generating plants, typically include two or more operating units. Each operating unit includes a steam turbine and a source of steam where high pressure steam is admitted into the turbine inlet. The steam turbine assembly normally includes several pressure stages operating at successively lower pressures. The outlet of the lowest pressure stage exhausts into a condenser where the steam is condensed, producing a vacuum which is the discharge pressure of the last turbine stage. The condenser is an indirect heat exchanger where steam passes into one section of the heat exchanger while coolant, usually water, runs on the other side of the metal tubing separating the condensing steam from the coolant. There is accordingly a circulating water circuit where the water is heated in the condenser and cooled in a cooling tower or other heat sink.

The coolant, normally called circulating water, passes between the condenser, where it absorbs heat, and a cooling tower or heat exchanger, where it gives up heat. The condensed steam, normally called condensate, remains separate from the circulating water and is reheated to provide a source of steam to drive the turbine. There is accordingly a steam-condensate circuit where high pressure steam is made in a boiler, the pressure is reduced in the turbine and the steam is condensed in the condenser.

The efficiency of a power plant depends on many variables, one of which is the pressure in the condenser. Those skilled in the art will recognize that the difference between the steam pressure at the turbine inlet and the condensing pressure in the condenser is a measure of the potential work that can be accomplished.

Almost every generating plant ever built has one unit that is more efficient than the other. Almost universally, the more efficient unit is run much more than the less efficient unit. Thus, the more efficient unit will be run continuously, or longer and at higher loads than the less efficient unit, and the less efficient unit will be started, or run at higher loads, only when electrical demand cannot be met by the first unit or when maintenance or construction requires that the more efficient unit be shut down. Thus, the less efficient unit is used only in periods of peak demand or when maintenance or repair work is being done on the more efficient unit.

Disclosures of some interest relative to this invention are found in U.S. Pat. Nos. 3,881,548 and 4,291,537.

SUMMARY OF THE INVENTION

In this invention, part of the condensate from the efficient or normally operating unit is cooled in the less efficient unit and then sprayed into the condenser of the more efficient unit to assist steam condensing at the turbine outlet. This is normally done when the less efficient unit is not running but it may be done when the less efficient unit is running at less than full capacity by the use of appropriate sensors and control valves.

Circulating water normally flows in the condenser of the operating unit to condense exhaust steam in a closed indirect heat exchanger, i.e. steam is typically travelling on the outside of a tube bundle heat exchanger and coolant runs inside tubes in the bundle. Hot condensate collects in the bottom of the condenser and is normally pumped through the steam-condensate circuit, passing first through a low pressure feed water or condensate heater and then into a boiler. Part of the reheating of the condensate is done by steam extracted from the turbine and delivered to the low pressure heater in a manner well known in the art.

In this invention, part of the hot condensate from the operating unit is diverted to the condenser of the less efficient unit where it is cooled to near ambient. The cool condensate is then sprayed into the condenser of the more efficient unit to condense steam in the condenser to produce a lower outlet pressure in the turbine thereby increasing the pressure differential between the inlet and outlet ends of the turbine and thereby increasing the turbine output.

In a way, this is counterintuitive because the heat given up by the cool condensate in the condenser of the less efficient unit must be added, at a cost, in the boiler of the more efficient unit. The gain in output from the turbine is of greater value than the loss caused by an increased heat requirement in the more efficient unit. Although this invention is ideally adapted to situations where the less efficient unit is not operating to produce electricity, gains in operating efficiency can be achieved where the less efficient unit is operating at low levels.

Make up water is often added to a steam circuit supplying steam to the turbine. Rather than simply adding make up water to the feed water heaters, as in the prior art, make up water is sprayed into the condenser of the operating unit. In this fashion, cooling of the condenser is obtained at no additional cost because the make up water would have to be heated in any event.

It is an object of this invention to provide improved efficiency in the operation of pairs of large steam power generating units.

It is an object of this invention to provide an optimzed condenser in a large power plant.

A further object of this invention is to provide a large electrical generating plant with an optimzed condenser in a nomrally operating generating unit by using some unused capacity in a generating unit operating at less than full capacity.

Another object of this invention is to provide a large electrical generating plant in which make up water is sprayed into the condenser of an operating generating unit.

These and other objects and advantages of this invention will become more apparent as this description proceeds, reference being made to the accompanying drawings and appended claims.

DETAILED DESCRIPTION

Figures 1, 2:
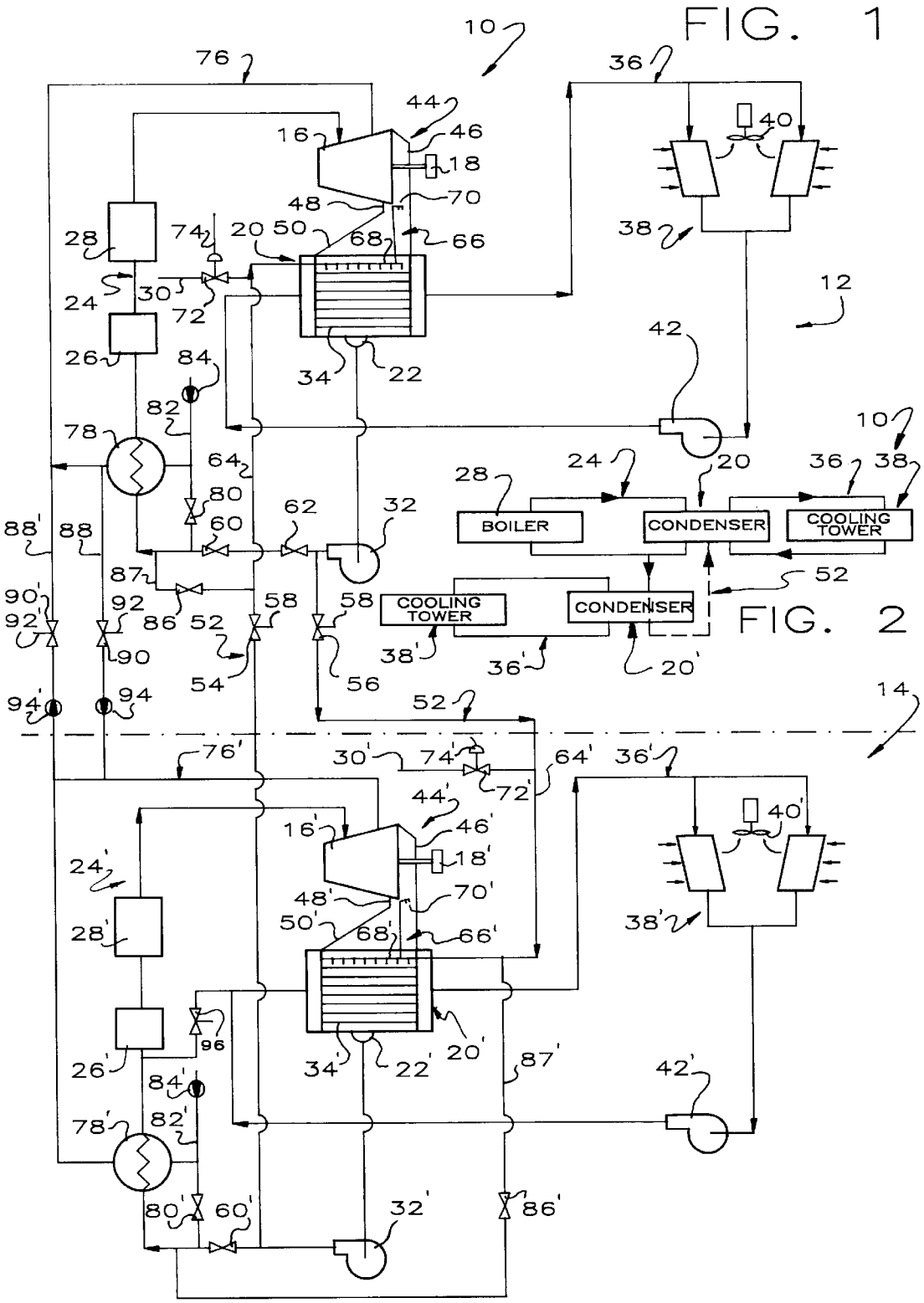
FIG. 1 is a schematic view of part of a large electrical genrating plant incorporating this invention.
FIG. 2 is a block diagram showing the interaction of the steam/condensate circuit, circulating water circuit and condensate circuit of this invention.

Referring to FIG. 1, a large electrical generating plant 10 comprises a more efficient operating unit 12 and a less efficient operating unit 14. The operating units 12, 14 are broadly identical and comprise a multi-stage turbine 16, 16' coupled to a generator 18, 18' for generating electricity. The turbines 16, 16' deliver low pressure steam to a condenser 20, 20' where the steam is condensed. Hot condensate collects in a hot well 22, 22'. A steam circuit 24, 24' collects hot condensate from the hot well 22, 22', adds heat through one or more feed water heaters 26, 26' and/or boilers 28, 28' and delivers high pressure steam to the turbines 16, 16'. Any make up feed water is delivered from a source through an inlet 30, 30'. The condensate is typically pumped to the heater 26, 26' by a condensate pump 32, 32'.

The condensers 20, 20' are indirect heat exchangers comprising tube bundles 34, 34' in which the steam or condensate is typically on the outside and circulating water is typically on the inside. A coolant circuit 36, 36' delivers hot circulating water from the condensers 20, 20' to a cooling tower 38, 38' or other heat sink giving up heat to the environment. Large fans 40, 40' draw air through the cooling towers 36, 36'. A pump 42, 42' delivers cool circulating water to the condensers 20, 20' for condensing steam at the turbine outlet.

The schematic nature of FIG. 1 fails to convey the size of the operating units 12, 14. A typical fifty to twelve hundred megawatt operating unit is housed in a multistory building in which the condensers 20, 20' are on the first floor and the turbines 16, 16' are on the third floor above a second floor mezzanine. The condensers 20, 20' include a duct 44, 44' connecting the downstream end of the turbine 16, 16' to the body of the condenser 20, 20'. The duct 44, 44' is typically made of 1" thick steel plate and includes an upper section 46, 46' of complex shape over the end of the turbine 16, 16', a square vertical duct section 48, 48' and a downwardly diverging section 50, 50' merging with the housing of the condenser 20, 20'. A typical square vertical duct section 48, 48' is fourteen feet on a side and about twenty feet tall with the other components comparably sized.

Those skilled in the art will recognize the electrical generating plant 10, as heretofore described, as being a typical steam powered electrical generating plant although the illustrated position of the feed water inlet 30 is not.

In this invention, most of the condensate from the condenser 20 is delivered to the steam circuit 24 in a conventional manner but part of the condensate from the condenser 20 is delivered to the condenser 20' of the less efficient unit 14, cooled and then returned to the condenser 20 as a spray to condense steam at the outlet of the turbine 16. Thus, as shown in FIG. 2, the conventional steam and circulating water circuits 24, 34, shown in solid lines, are modified by a second condensate circuit 52 where condensate from the more efficient operating unit 12 is cooled in the condenser 20' of the less efficient operating unit 14 and returned to the condenser 20 for more efficiently condensing steam at the outlet of the turbine 16. It will be seen that heat transfer in the condensers 20, 20' between the circulating water and condensate is of an indirect type where the circulating water and steam/condensate remain separate. It will also be seen that cool condensate from the condenser 20' is in direct heat exchange with hot steam/condensate in the condenser 20.

Referring to FIG. 1, this is accomplished by dividing the output of the condenser pump 32 into a first stream circulated through the steam circuit 24 in a conventional manner and a second stream delivered to the condenser 20'. To this end, the second condensate circuit 52 includes flow control valves 54, 56 which may desirably be controlled by a signal on an electrical control wire 58 which act in cooperation with existing valves 60, 60'.

The second condensate circuit 52 includes conduits 64, 64' leading to spray assemblies 66, 66' comprising a first section 68, 68' in the condenser 20, 20' and a second section 70, 70' in the vertical duct 48, 48', in the transition section 46, 46' or both. It will accordingly be seen that the second condensate circuit 52 is generally symmetrical in that it has substantially identical components in the first and second operating units 12, 14.

Operation in a First Mode

It is assumed that the less efficient operating unit 14 is not operating at all. The valve 60' will accordingly be closed because there is no circulation in the steam circuit 24'. The circulating pump 42' and the cooling tower 38' are operated in an appropriate manner considering the heat load imposed by the hot condensate from the unit 12 which is circulating in the condenser 20'. The flow control valve 56 delivers a small fraction of hot condensate from the condenser 20 to the spray assembly 66' in the condenser 20' where it is cooled by water circulating in the circuit 36'. An appropriate amount of make up water is admitted through the inlet 30 so the amount of water circulating in the steam circuit 24 is sufficient to power the turbine 16 at the desired output.

In a conventional power plant, the make up water inlet 30 delivers make up water more-or-less directly to the feed water heater 26, 26'. In this invention, instead of the make up water inlet 30 delivering water directly to the steam circuit 24, the make up water inlet 30 connects to the conduit 64 through a flow control valve 72 controlled by an electrical signal in a control wire 74. Thus, when make up water is needed to be added to the system to have sufficient steam to operate the unit 12, the make up water is sprayed onto the hot operating condenser 20. This provides better condensation in the condenser 20 without additional heating costs because the make up water has to be heated in any event.

Cool condensate from the condenser 20' flows from the condenser 20' to the spray assembly 66, either by the pressure differential between the condensers 20, 20' or by pumping through the condensate pump 32'. This spray in the condenser 20 causes quicker, more complete condensation of steam exiting from the turbine 16 and accordingly reduces the back pressure on the turbine 16. Because the back pressure on the turbine 16 is reduced, more horsepower is produced. The effect of the second condensate circuit 52 varies, depending on the loads on the first and second operating units 12, 14, but is typically up to 2.4%.

EXAMPLE 1

The following calculations are based on a primary unit with a maximum load rating of 325 megawatts (mw) running at 203 mw with a flow rate in the condensing turbine outlet of 911,762 pounds/hour. At these conditions, the pressure in the condenser is about 3" Hg. If the total flow rate is increased to one and a half times maximum condensate flow rate, at full load the total flow rate is about 2,300,000 pounds/hour so about 900,000 pounds/hour continues to flow through the turbine and about 1,400,000 pounds/hour flows through the condenser of the non-operating unit. There is no requirement to replace or enlarge the existing condensate pump 32 because such pumps normally have excess pumping capacity. The reasonable assumption is made that condensate flowing to the non-operating unit 14 cools to ambient wet bulb temperature because of the large capacity of the condenser 20' and the cooling tower 36'.

At typical temperature of 53° F. ambient wet bulb, enthalpy of condensate or $h_f$=21 btu/pound. Subtracting typical condensate enthalpy at 3" Hg backpressure where $h_f$=82 gives 61 btu/pound.

Calculating cooling available=1,400,000 pounds/hour×61 btu/pound=8.54×$10^7$ btu/hour. It is known that the total cooling requirement per pound of circulating steam is 950 btu/pound. Calculating the percentage this is of all cooling needed by the operating unit 12 (8.54×$10^7$ btu/hour)/(911,762 pounds/hr×950 btu/pound)×100=10%.

Since the vacuum in the condenser 20 of the operating unit 12 is proportional to the flow rate of heat removal, and the vacuum goes from near zero at near zero mw load to about 3" Hg at 203 mw, solving for the reduction in backpressure (using typical curves of backpressure versus condenser loading) gives a 0.45" Hg vacuum improvement for a 10% reduction in condenser loading. Operating units experience a larger increase in back pressure at higher loads than at lower loads for the same increase in heat loading.

TABLE 1

| Typical turbine/condenser heat rates at various back pressures and loads in (Btu per kw-hr) | | | | |
|---|---|---|---|---|
| Pressure In. Hg Abs. | 325 mw | 284 mw | 203 mw | 144 mw |
| .3 | 7536 | 7506 | 7469 | 7515 |
| .5 | 7521 | 7512 | 7524 | 7623 |
| 1.0 | 7550 | 7573 | 7682 | 7865 |
| 1.5 | 7635 | 7683 | 7846 | 8086 |
| 2.0 | 7742 | 7789 | 7997 | 8300 |
| 2.5 | 7837 | 7883 | 8135 | 8474 |

Solving for average improvement per 0.5 Hg improvement in condenser pressure, using 203 mw column: [(8135−7997)+(7997−7846)+(7846−7682)+(7682−7524)]/4=152. By referencing Table 1, this is converted to 136 btu/kw-hr average improvement (0.45/0.5×152 btu/kw-hr). At this load, one can calculate from Table 1, an average turbine/condenser heat rate of 7775 btu/kw-hr. Calculating this improvement as a percentage:

(136/7775)×100=1.8%.

Converting this from turbine/condenser efficiency improvement to overall unit efficiency with a typical plant hear rate of 10,500 btu/kw-hr:

1.8%×10500/7775=2.4%.

EXAMPLE 2

Both Units Running

Most units have twice the increase in backpressure at high loads versus at low loads for the same increase in heat load. This is part of the efficiency improvement due to this invention, the other part is due to more megawatts of generation occurring in the high load unit versus the penalty in the low load unit. Calculating the percent efficiency improvement using the same units and unit conditions as in Example 3 below where the enthalpy difference is 47 btu/lb.

Adjusting Example 1 for this enthalpy difference:

47/61×136 btu/kw-hr=104.8 btu/kw-hr.

Adjusting this turbine/condenser efficiency improvement to obtain an efficiency improvement for the entire unit with a typical heat rate at this load of 7775 btu/kw-hr for the turbine/condenser (see Table 1) and 10,500 btu/kw-hr for the entire unit at full load:

104.8btu/kw-hr×10500/7775=141.5 btu/kw-hr.

To illustrate the value of these improvements, the following assumptions are made: fuel cost is \$3 per $10^6$ btu, these conditions of improved efficiency occur one half the time, such as at night or on weekends where the low load unit is being run at much less than full capacity, the low load condenser has one half the heat rate effect of the high load unit for the same heat load which is typical.

The high load unit benefit calculates to be:

141.5 btu/kw-hr×325,000 kw×\$3/$10^6$×12 hrs/day×365 days/year=\$604,276/year.

The cost in the low load unit calculates to be:

141.5 btu/kw-hr×½×31,000 kw×\$3/$10^6$×12 hrs/day×365 days/year=\$28,819/year.

The net savings is, of course, \$604,276−28,819=\$575,476 per year. Calculations show that about 4.7% of the gain is lost in the low load unit. From Example 1 where 136 btu/kw-hr is about 2.4% efficiency improvement, converting this to overall unit efficiency improvement=(104.8 btu/kw-hr)/(136 btu/kw-hr)×2.4×(100−4.7)=1.8%.

At Times of Choking Flow

Choking flow refers to that situation where two phase low pressure steam/water flow in the last section of the turbine 16 and/or duct 44 is critical, i.e. no greater volume of fluid flow occurs when an increased pressure differential exists in this part of the turbine 16 or duct 44. Thus, choking flow may occur in the vertical duct section 48 and occurs when the turbine 16 is running at maximum or near maximum load. Because the second spray assembly 70 is at the uppermost end of the vertical duct 48 some of the low pressure steam exiting from the turbine 16 is immediately condensed whereupon more flow in the duct 44 can occur. This may be compared to removing a bottleneck or limit on maximum operation of the turbine 16 because choking flow will not occur in the duct 44 until higher flow rates are achieved.

Operation in a Second Mode

If the less efficient operating unit 14 is operating at less than full capacity compared to what the more efficient unit 12 is operating at, there is some hot condensate in the condenser 20 that can be used beneficially in steam circuit 24'. In this circumstance, the flow control valve 56 is manipulated to deliver a stream of hot condensate to the condenser 20' and the flow control valve 86 can be opened to deliver most of the output from the condenser 20 to the steam circuit 24'. The second condenser circuit 52 returns the same amount of condensate back to the condenser 20 by manipulation of the control valve 54.

Because the second condensate circuit 52 is symmetrical, it will be seen that if the less efficient unit 14 is running at low loads and the more efficient unit 12 is running at higher loads, by replacing the condensate makeup of the less efficient unit with the hotter high load unit condensate, there are improved efficiencies. In this event, increased efficiency is achieved in the less efficient unit because there is a savings in the amount of steam extracted to reheat the condensate in that unit's heaters. This steam saved can now go through the turbine to perform useful work.

EXAMPLE 3

Knowing the following typical conditions for two 325 mw maximum rated operating units:

TABLE 2

| | primary unit | secondary unit |
|---|---|---|
| load | 325 mw | 72 mw |
| backpressure | 3" Hg | .75" Hg |
| saturation temperature at this backpressure | 116° F. | 70° F. |
| enthalpy of condensate at this temperature | 82 btu/lb | 35 btu/lb |

The difference in enthalpy in the two condenser streams is 82–35 or 47 btu/pound of condensate.

Using a secondary unit load of 72 mw and knowing the typical turbine/condenser heat rate, one may calculate the percentage gain in the secondary unit heat rate by replacing its condensate supply with primary unit condensate. At 72 mw, the condensate flow rate is 310,790 pounds/hour. The percentage efficiency gain=[(310790 lbs/hr×47 btu/lb/72000 kw)/7775 btu/kw-hr]=0.026×100=2.6%. Converting this to the overall heat rate for a typical unit with 12700 btu/kw-hr heat rate at this load, which is 22% of full load:

2.6%×12700/7775=4.25% gain.

Operation in a Third Mode

As stated previously, a normal technique is to take some intermediate or low pressure steam from the turbines to heat condensate or feed water in the heaters 26, 26'. To this end, a conventional power plant includes a steam line 76, 76' running from an intermediate or low pressure stage of the turbine 16, 16' through an indirect low pressure feed water heater 78, 78'.

By adding a circuit with a valve 80, 80' to control flow from the circuit 24, 24' upstream of the heater 78, 78', sufficient heated condensate flashes to steam to reverse steam flow in the conduit 76' under normal operating conditions, i.e. the unit 12 is operating at much higher loads than the unit 14. If the unit 14 is operating at the higher load, flow in the conduit 76 is reversed. A motive steam line 82, 82' from a source of steam, such as heater vents which remove trapped air or steam in heater vessels, connects to the line 76, 76' to assist driving condensate toward the main feed water heater 26, 26'. A check valve 84, 84' may be provided as desired.

Normally, pressure in the intermediate stage of the turbine 16 is higher than in the low pressure heater 78 so normal flow is from the turbine 16 toward the low pressure heater 78. When the operating unit 12' is running at low loads and the operating unit 12 is running at high loads, the pressure in the condenser 20' is normally much less than pressure in the condenser 20. In this situation, it may be desirable to reverse the flow direction in the steam line 76' and provide a source of low pressure steam to the turbine 16'. In this situation, there is considerable condensate circulating in the circuit 24' upstream of the heater 78' because the valve 86', in a bypass circuit 87', is partly open and recirculation of the condensate through valve 96 occurs A suitable steam line 88 can also be provided connecting the steam lines 76, 76'. A valve 90 controls the amount of steam passing through the steam line 88 and is, in turn, controlled by a signal on a control wire 92. A suitable check valve 94 ensures the flow direction is always correct. In the event the operating unit 12 is often run at lower loads than the operating unit 12', a duplicate circuit may be provided by the addition of the steam line 88', the valve 90', control wire 92', and check valve 94'. The gain in efficiency is, of course, in the unit that is operating at low loads.

EXAMPLE 4

The following calculations are based on two typical units condensate flashing only and not using circuits 88, 88', each with a maximum load rating of 325 mw under the following typical conditions:

| | primary unit | secondary unit |
|---|---|---|
| condenser pressure | 4" Hg | 1" Hg |
| current operating load | 325 mw | 31 mw |
| turbine efficiency, alone | 90% | 90% |
| overall heat rate efficiency | | 12500 btu/kw hr |
| maximum flow possible on lowest pressure heater | | 60,000 lbs/hr |
| condensate enthalpy | 94 btu/lb | 47 btu/lb |

Calculating the improvement in efficiency if 100% of the maximum flow from the lowest pressure heater is reversed:

[60,000 lb/hr×(94–47)btu/lb/31,000 kw]/3413=0.027×100=2.7%. Adjusting this to overall unit efficiency:

2.7%×0.9×12500/3413=8.9%.

This number is astonishing large because this improvement is acting directly on the turbine and losses in other areas, such as boiler losses, condenser losses and the like, which are already taken into account and which do not change. This improvement is possible because calculations indicate the lowest pressure feed water can transfer this amount of energy.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. An electrical generating facility including first and second electrical generating units each including a steam turbine, an electrical generator driven by the turbine, a motive fluid circuit for receiving condensate from a condenser and delivering steam to the turbine, and a circulating coolant circuit including an indirect heat exchange condenser receiving steam from the turbine for withdrawing heat from the steam and converting the steam to condensate, a heat exchanger for giving up heat from the coolant, and piping connecting the condenser and heat exchanger in a circuit for circulating coolant through the condenser and heat exchanger, the first electrical generating unit being more efficient than the second electrical generating unit and being the normally operating unit, the second electrical generating unit normally delivering less than its full capacity and being put into high load service in times of large demand, the improvement comprising means dividing condensate from the condenser of the first generating unit into a first stream delivered to the motive fluid circuit and a second stream;

means delivering the second stream of condensate to the condensing means of the second generating unit and cooling the second stream of condensate; and means delivering the cooled second stream of condensate into the condenser of the first generating unit for condensing steam in the condenser of the first generating unit whereby condensate of the first generating unit is cooled in the condensing means of the second generating unit and unused capacity of the second generating unit is used by the first generating unit at a time when the second generating unit is operating at less than full capacity.

2. The electrical generating facility of claim 1 further comprising a duct communicating between the turbine and the condenser comprising a first section of complex shape over an outlet end of the turbine, a vertical duct section extending downwardly from the first section and a main condenser section housing the indirect heat exchange condenser, the delivering means comprising means for spraying water in the vertical duct section adjacent an upper end thereof.

3. The electrical generating facility of claim 2 wherein the spraying means comprises means for spraying water in the main condenser section onto the indirect heat exchange condenser.

4. The electrical generating facility of claim 1 further comprising a duct communicating between the turbine and the condenser wherein the duct comprises a first section of complex shape over an outlet end of the turbine, a vertical duct section extending downwardly from the first section and a main condenser section housing the indirect heat exchange condenser, and wherein the spraying means comprises means for spraying water in the main condenser section onto the indirect heat exchange condenser.

5. The electrical generating facility of claim 1 comprising a make up water inlet for supplying make up water to the facility and means for spraying make up water into the condenser in direct heat exchange with steam exiting from the turbine for condensing the steam.

6. The electrical generating facility of claim 1 further comprising means for taking low pressure steam from an intermediate section of the turbine of the first operating unit and delivering the low pressure steam into an intermediate section of the turbine of the second operating unit.

7. An electrical generating facility including first and second electrical generating units each including a steam turbine, an electrical generator driven by the turbine, a motive fluid circuit for receiving condensate from a condenser and delivering steam to the turbine, and a circulating coolant circuit including an indirect heat exchange condenser receiving steam from the turbine for withdrawing heat from the steam and converting the steam to condensate, a heat exchanger for giving up heat from the coolant, and piping connecting the condenser and heat exchanger in a circuit for circulating coolant through the condenser and heat exchanger, the first operating unit operating at a higher load than the second unit and the condenser of the first operating unit operating at a higher backpressure than the condenser of the second operating unit, the improvement comprising means for taking low pressure steam from an intermediate section of the turbine of the first operating unit and delivering the low pressure steam into an intermediate section of the turbine of the second operating unit.

8. An electrical generating facility including first and second electrical generating units each including a steam turbine, an electrical generator driven by the turbine, a motive fluid circuit for receiving condensate from a condenser and delivering steam to the turbine, and a circulating coolant circuit including an indirect heat exchange condenser receiving steam from the turbine for withdrawing heat from the steam and converting the steam to condensate, a heat exchanger for giving up heat from the coolant, and piping connecting the condenser and heat exchanger in a circuit for circulating coolant through the condenser and heat exchanger, the first electrical generating unit being operated at a higher load than the second electrical generating unit and having hotter condensate than the second electrical generating unit, the improvement comprising means delivering hotter condensate from the first electrical generating unit to the second electrical generating unit and delivering cooler condensate from the second electrical generating unit to the first electrical generating unit.

9. The electrical generating facility of claim 8 wherein the delivering means comprises means for spraying the cooler condensate from the second electrical generating unit onto the indirect heat exchange condenser of the first electrical generating unit.

10. The electrical generating facility of claim 9 further comprising a duct communicating between the turbine and the condenser wherein the duct comprises a first section of complex shape over the outlet end of the turbine, a vertical duct section extending downwardly from the first section and a main condenser section housing the indirect heat exchange condenser, and wherein the delivering means comprising means for spraying the cooler condensate from the second electrical generating unit section onto the indirect heat exchange condenser of the first electrical generating unit.

11. The electrical generating facility of claim 8 comprising a make up water inlet for supplying make up water to the facility and means for spraying make up water into the condenser of the first electrical generating unit in direct heat exchange with steam exiting from the turbine for condensing the steam.

* * * * *